US008024839B2

(12) United States Patent
Lewis, II

(10) Patent No.: US 8,024,839 B2
(45) Date of Patent: Sep. 27, 2011

(54) INDEXING HINGE

(75) Inventor: Richard Evans Lewis, II, Austin, TX (US)

(73) Assignee: Chatsworth Products, Inc., Westlake Village, CA (US)

( * ) Notice: Subject to any disclaimer, the term of this patent is extended or adjusted under 35 U.S.C. 154(b) by 0 days.

(21) Appl. No.: 11/691,325

(22) Filed: Mar. 26, 2007

(65) Prior Publication Data

US 2007/0220708 A1 Sep. 27, 2007

Related U.S. Application Data

(60) Provisional application No. 60/743,787, filed on Mar. 26, 2006.

(51) Int. Cl.
*E05D 7/10* (2006.01)

(52) U.S. Cl. ..... 16/266; 16/334

(58) Field of Classification Search ..... 16/266, 16/354, 355, 319, 321, 334, 342, 335, 382, 16/387, 389; 220/845, 831, 832, 833, 834, 220/847, 848, 884; 361/692; 312/292
See application file for complete search history.

(56) References Cited

U.S. PATENT DOCUMENTS

| | | | | | |
|---|---|---|---|---|---|
| 555,583 | A | | 3/1896 | Pletcher | |
| 1,564,611 | A | * | 12/1925 | Mountford et al. | 16/322 |
| 1,589,613 | A | * | 6/1926 | Mountford et al. | 16/334 |
| 2,206,739 | A | * | 7/1940 | Brogren et al. | 16/354 |
| 2,817,870 | A | | 12/1957 | Howell | |
| 3,008,177 | A | | 11/1961 | Wooten | |
| 3,247,312 | A | | 4/1966 | Allessi | |
| 3,298,195 | A | * | 1/1967 | Raskhodoff | 62/414 |
| 3,471,874 | A | * | 10/1969 | Dixon | 4/240 |
| 3,488,795 | A | | 1/1970 | Marguelisch | |
| 3,778,932 | A | | 12/1973 | Ewing | |
| 4,398,564 | A | | 8/1983 | Young et al. | |
| 4,417,366 | A | | 11/1983 | Salice | |
| 4,495,545 | A | * | 1/1985 | Dufresne et al. | 361/695 |

(Continued)

FOREIGN PATENT DOCUMENTS

EP 2205054 A1 7/2010

(Continued)

OTHER PUBLICATIONS

"International Search Report" and "Written Opinion of the International Searching Authority" in Chatsworth Products, Inc. on Nov. 19, 2007, for International Patent Applicatiol Serial No. PCT/US2007/64951 filed on Mar. 26, 2007, 10 pages.

(Continued)

*Primary Examiner* — Victor Batson
*Assistant Examiner* — Matthew Sullivan
(74) *Attorney, Agent, or Firm* — Tillman Wright, PLLC; James D. Wright; Chad D. Tillman

(57) ABSTRACT

An indexing hinge comprises a two arm hinge half and an axle hinge half. The two arm hinge half includes two hinge arms, a projecting indexing element disposed therebetween and a first mounting element. The axle hinge half includes two axles, each extending from a toothed indexing element, and a second mounting element. When the axle hinge half is connected to the two arm hinge half by interconnecting each axle with a respective hinge arm, the projecting indexing element abuts the toothed indexing element in such a way as to prevent rotation unless an additional rotational torque is applied. An electronic equipment enclosure installation comprises an electronic equipment enclosure and an indexing hinge.

23 Claims, 17 Drawing Sheets

U.S. PATENT DOCUMENTS

| | | | | |
|---|---|---|---|---|
| 4,502,609 | A | 3/1985 | Christatos | |
| 4,506,408 | A * | 3/1985 | Brown | 16/225 |
| 4,509,930 | A | 4/1985 | Schweigert et al. | |
| 4,631,937 | A | 12/1986 | Debus et al. | |
| 4,648,007 | A * | 3/1987 | Garner | 361/695 |
| 4,803,756 | A | 2/1989 | Hufnagel | |
| 4,974,289 | A * | 12/1990 | Piard | 16/228 |
| 5,020,866 | A | 6/1991 | McIlwraith | |
| 5,024,251 | A | 6/1991 | Chapman | |
| 5,235,136 | A | 8/1993 | Santucci et al. | |
| 5,632,066 | A | 5/1997 | Huong | |
| 5,806,945 | A | 9/1998 | Anderson et al. | |
| 5,864,922 | A * | 2/1999 | Kraft | 16/266 |
| 5,957,345 | A | 9/1999 | Petrou et al. | |
| 5,971,187 | A * | 10/1999 | Clee et al. | 220/4.29 |
| 5,991,975 | A * | 11/1999 | Baer | 16/354 |
| 6,107,575 | A | 8/2000 | Miranda | |
| 6,181,557 | B1 * | 1/2001 | Gatti | 361/695 |
| 6,215,069 | B1 | 4/2001 | Martin et al. | |
| 6,261,026 | B1 * | 7/2001 | Conley et al. | 403/397 |
| 6,263,543 | B1 * | 7/2001 | Daoud | 16/342 |
| 6,354,461 | B1 * | 3/2002 | Tenney et al. | 220/836 |
| 6,437,243 | B1 | 8/2002 | VanderVelde et al. | |
| 6,437,244 | B1 | 8/2002 | VanderVelde et al. | |
| 6,489,565 | B1 | 12/2002 | Krietzman et al. | |
| 6,510,589 | B2 | 1/2003 | Schrage | |
| 6,605,782 | B1 | 8/2003 | Krietzman et al. | |
| 6,668,565 | B1 * | 12/2003 | Johnson et al. | 62/89 |
| 6,710,240 | B1 * | 3/2004 | Chen et al. | 174/17 VA |
| 6,766,093 | B2 | 7/2004 | McGrath et al. | |
| 6,806,944 | B2 * | 10/2004 | Votipka et al. | 355/75 |
| 6,884,942 | B2 | 4/2005 | McGrath et al. | |
| 6,926,363 | B2 | 8/2005 | Yamashita | |
| 6,946,605 | B2 | 9/2005 | Levesque et al. | |
| 6,968,647 | B2 | 11/2005 | Levesque et al. | |
| 6,993,808 | B1 | 2/2006 | Bennett et al. | |
| 7,026,553 | B2 | 4/2006 | Levesque et al. | |
| 7,041,912 | B2 | 5/2006 | Kadrnoska et al. | |
| 7,075,788 | B2 * | 7/2006 | Larson et al. | 361/695 |
| 7,119,282 | B2 | 10/2006 | Krietzman et al. | |
| 7,178,292 | B2 | 2/2007 | Yamada | |
| 7,225,586 | B2 | 6/2007 | Levesque et al. | |
| 7,804,685 | B2 | 9/2010 | Krietzman | |
| 2003/0020379 | A1 | 1/2003 | Larsen et al. | |
| 2003/0226238 | A1 * | 12/2003 | Baer | 16/354 |
| 2004/0007348 | A1 * | 1/2004 | Stoller | 165/47 |
| 2004/0050808 | A1 | 3/2004 | Krampotich et al. | |
| 2004/0190270 | A1 | 9/2004 | Aldag et al. | |
| 2005/0115152 | A1 | 6/2005 | Levesque et al. | |
| 2005/0115737 | A1 | 6/2005 | Levesque et al. | |
| 2006/0162948 | A1 | 7/2006 | Rinderer et al. | |
| 2006/0285291 | A1 * | 12/2006 | Elkins | 361/695 |
| 2007/0064389 | A1 | 3/2007 | Lewis, II et al. | |
| 2007/0210679 | A1 | 9/2007 | Adducci et al. | |
| 2007/0210680 | A1 | 9/2007 | Appino et al. | |
| 2007/0210681 | A1 | 9/2007 | Adducci et al. | |
| 2007/0210683 | A1 | 9/2007 | Adducci et al. | |
| 2007/0210686 | A1 | 9/2007 | Adducci et al. | |
| 2007/0221393 | A1 | 9/2007 | Adducci et al. | |
| 2008/0141495 | A1 * | 6/2008 | Fisher | 16/343 |
| 2008/0174217 | A1 | 7/2008 | Walker | |
| 2008/0180004 | A1 | 7/2008 | Martich et al. | |
| 2009/0061755 | A1 * | 3/2009 | Calder et al. | 454/184 |
| 2009/0190307 | A1 | 7/2009 | Krietzman | |
| 2009/0224110 | A1 | 9/2009 | Donowho et al. | |
| 2009/0227197 | A1 | 9/2009 | Lewis, II et al. | |
| 2009/0236117 | A1 | 9/2009 | Garza et al. | |
| 2009/0239461 | A1 | 9/2009 | Lewis, II et al. | |
| 2010/0172092 | A1 | 7/2010 | Davis et al. | |
| 2011/0019362 | A1 | 1/2011 | Krietzman | |

FOREIGN PATENT DOCUMENTS

| | | | |
|---|---|---|---|
| WO | 9948305 | A1 | 9/1999 |
| WO | 2009089008 | A2 | 7/2009 |
| WO | 2009089306 | A1 | 7/2009 |
| WO | 2009089307 | A2 | 7/2009 |

OTHER PUBLICATIONS

"International Search Report" and "Written Opinion" of the International Searching Authority (Korean Intellectual Property Office) in Chatsworth Products, Inc. et al., International Patent Application Serial No. PCT/US2009/030369, filed on Jan. 7, 2009 mailed on Oct. 12, 2009 and completed on Oct. 9, 2009, 9 pages.

* cited by examiner

INDEXING HINGE

CROSS-REFERENCE TO RELATED APPLICATION

For purposes of the United States, the present application is a U.S. nonprovisional patent application of, and claims priority under 35 U.S.C. §119(e) to, U.S. Provisional Patent Application No. 60/743,787 filed Mar. 26, 2006, which provisional patent application is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to hinges for small doors, and, in particular, to selectively positionable hinges for small doors for electronic equipment cabinets, ventilation ducts, and the like.

2. Background

Racks, frames, cabinets and the like for supporting computer and other electronic equipment are very well known. Such support apparatus are often partially or fully enclosed, either directly through the use of doors and other panels mounted directly thereon, or indirectly by lining several such apparatuses up in a row such that the sides of each rack are immediately adjacent another rack.

Often doors and other panels are mounted to the support apparatus with hinges, which conveniently make it possible to open and close the doors and other panels without removing them from the support apparatus. A door or other panel may be opened to access electronic equipment disposed within the support apparatus. Additionally, a door or other panel may be opened to allow air to flow through the support apparatus for cooling purposes.

A traditional hinge is able to rotate freely about its pivot axis, through its range of rotation, once the door or other panel to which it is attached has been disengaged from the support apparatus or opened. Such free rotation is often undesirable, as it may cause a safety hazard to technicians accessing equipment within the support apparatus and to other personnel working within the area where the support apparatus is located. Accordingly, it is desirable to provide a hinge that may be fixed at predetermined positions about its range of rotation such that the hinge does not rotate freely therethrough. Such hinge may be rotated with the application of a small amount of rotational torque; however, the hinge may not rotate freely. With such a novel hinge, a person may open a door or other panel on a support apparatus and fix the door or panel in a desired position within its range of rotation. The hinge, and therefore the door or panel, remains in the desired position until enough rotational torque is applied to the hinge to move it to another position.

While the need for such a hinge has been described in the context of support apparatus for electronic equipment, it will be understood that such hinge may be used in many applications, which will be clear to the Ordinary Artisan.

SUMMARY OF THE PRESENT INVENTION

Broadly defined, the present invention according to one aspect is an indexing hinge comprising a two arm hinge half and an axle hinge half. The two arm half hinges includes two hinge arms, a projecting indexing element disposed therebetween, and a first mounting element adapted to mount and connect the two arm hinge half to a first structure of an electronic equipment support apparatus. The axle hinge half includes two axles, each extending from a toothed indexing element, and a second mounting element adapted to mount and connect the axle hinge half to a second structure of an electronic equipment support apparatus. When the axle hinge half is connected to the two arm hinge half by interconnecting each axle with a respective hinge arm, the projecting indexing element abuts the toothed indexing element in such a way as to prevent rotation unless an additional rotational torque is applied.

In features of this aspect, each axle has two flat surfaces arranged therein to permit interconnection of the axle to a respective hinge arm, the toothed indexing element is formed in the shape of a nearly complete cylinder and extends from a proximal end of the second mounting element such that the axis of the cylinder generally parallels the proximal end of the mounting element, and the cylinder defines curved surfaces and two bases. The toothed indexing element includes a plurality of teeth covering the curved surfaces of the cylinder, and the teeth extend generally from one cylinder base to the other and defines a plurality of detents therebetween.

In further features, the projecting indexing element includes a short protrusion with a rounded or beveled tip that abuts the toothed indexing element in such a way as to prevent rotation unless an additional rotational torque is applied, and the two hinge arms each include an approximately arcuate hinge barrel section for interconnection with a respective axle. In accordance with this feature, each hinge barrel section defines a partially-enclosed opening of substantially cylindrical cross-section, and the two hinge barrel sections are aligned such that the cylindrical openings are collinear. It is preferred that a distance from a tip of the projecting indexing element to a center of the cylindrical openings is greater than a radius of the cylindrical openings and the tip of the projecting indexing element is arranged to interact with the toothed indexing element in such a way as to prevent rotation unless an additional rotation torque is applied.

In additional features of this aspect, the first mounting element and the second mounting element each include a first mounting section and a second mounting section separated by a slot, wherein a U-shaped structure is disposed. With regard to this feature, the U-shaped structure includes a ramped structure and a tapered structure disposed in opposing facing relation to one another to aid in mounting the corresponding hinge half to a door, wall or other planar structure.

In other features of this aspect, the hinge arms act as a spring by extending and contracting slightly as the projecting indexing element and toothed indexing element interact with one another when the additional rotational torque is applied to the indexing hinge to cause rotation thereof and the projecting indexing element abuts the toothed indexing element in such a way as to enable selective positioning resistant to flowing air.

The present invention according to a second aspect is an electronic equipment enclosure installation comprising an electronic equipment enclosure, and an indexing hinge. The indexing hinge comprises a two arm hinge half and an axle hinge half. The two arm hinge half includes two hinge arms, a projecting indexing element disposed therebetween, and a first mounting element adapted to mount and connect the two arm hinge half to a first structure of an electronic equipment support apparatus. The axle hinge half includes two axles, each extending from a toothed indexing element, and a second mounting element adapted to mount and connect the axle hinge half to a second structure of an electronic equipment support apparatus. When the axle hinge half is connected to the two arm hinge half by interconnecting each axle with a respective hinge arm, the projecting indexing element abuts the toothed indexing element in such a way as to prevent rotation unless an additional rotational torque is applied.

In features of this aspect, each axle has two flat surfaces arranged therein to permit interconnection of the axle to a respective hinge arm, the toothed indexing element is formed in the shape of a nearly complete cylinder and extends from a proximal end of the second mounting element such that the axis of the cylinder generally parallels the proximal end of the mounting element, and the cylinder defines curved surfaces and two bases. The toothed indexing element includes a plurality of teeth covering the curved surfaces of the cylinder, and the teeth extend generally from one cylinder base to the other and define a plurality of detents therebetween.

In further features of this aspect, the projecting indexing element includes a short protrusion with a rounded or beveled tip that abuts the toothed indexing element in such a way as to prevent rotation unless an additional rotational torque is applied, and the two hinge arms each include an approximately arcuate hinge barrel section for interconnection with a respective axle. With regard to this feature, each hinge barrel section defines a partially-enclosed opening of substantially cylindrical cross-section, and the two hinge barrel sections are aligned such that the cylindrical openings are collinear. It is preferred that a distance from a tip of the projecting indexing element to a center of the cylindrical openings is greater than a radius of the cylindrical openings and that the tip of the projecting indexing element is arranged to interact with the toothed indexing element in such a way as to prevent rotation unless an additional rotation torque is applied.

In an additional feature, the first mounting element and the second mounting element each include a first mounting section and a second mounting section separated by a slot, wherein a U-shaped structure is disposed. With regard to this feature, the U-shaped structure includes a ramped structure and a tapered structure disposed in opposing facing relation to one another to aid in mounting the corresponding hinge half to a door, wall or other planar structure.

In other features, the hinge arms act as a spring by extending and contracting slightly as the projecting indexing element and toothed indexing element interact with one another when the additional rotational torque is applied to the indexing hinge to cause rotation thereof and the projecting indexing element abuts the toothed indexing element in such a way as to enable selective positioning resistant to flowing air.

The present invention according to a third aspect is an indexing hinge comprising a two arm hinge half and an axle hinge half. The two arm half hinges includes two hinge arms, a projecting indexing element disposed therebetween, and a first mounting element adapted to mount and connect the two arm hinge half to a first structure. The axle hinge half includes two axles, each extending from a toothed indexing element, and a second mounting element adapted to mount and connect the axle hinge half to a second structure. When the axle hinge half is connected to the two arm hinge half by interconnecting each axle with a respective hinge arm, the projecting indexing element abuts the toothed indexing element in such a way as to prevent rotation and enable selective positioning resistant to flowing air unless an additional rotational torque is applied by user.

In features of this aspect, each axle has two flat surfaces arranged therein to permit interconnection of the axle to a respective hinge arm, the toothed indexing element is formed in the shape of a nearly complete cylinder and extends from a proximal end of the second mounting element such that the axis of the cylinder generally parallels the proximal end of the mounting element, and the cylinder defines curved surfaces and two bases. The toothed indexing element includes a plurality of teeth covering the curved surfaces of the cylinder, and the teeth extend generally from one cylinder base to the other and defines a plurality of detents therebetween.

In further features, the projecting indexing element includes a short protrusion with a rounded or beveled tip that abuts the toothed indexing element in such a way as to prevent rotation unless an additional rotational torque is applied, and the two hinge arms each include an approximately arcuate hinge barrel section for interconnection with a respective axle. In accordance with this feature, each hinge barrel section defines a partially-enclosed opening of substantially cylindrical cross-section, and the two hinge barrel sections are aligned such that the cylindrical openings are collinear. It is preferred that a distance from a tip of the projecting indexing element to a center of the cylindrical openings is greater than a radius of the cylindrical openings and the tip of the projecting indexing element is arranged to interact with the toothed indexing element in such a way as to prevent rotation unless an additional rotation torque is applied.

In additional features of this aspect, the first mounting element and the second mounting element each include a first mounting section and a second mounting section separated by a slot, wherein a U-shaped structure is disposed. With regard to this feature, the U-shaped structure includes a ramped structure and a tapered structure disposed in opposing facing relation to one another to aid in mounting the corresponding hinge half to a door, wall or other planar structure.

In another feature of this aspect, the hinge arms act as a spring by extending and contracting slightly as the projecting indexing element and toothed indexing element interact with one another when the additional rotational torque is applied to the indexing hinge to cause rotation thereof.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
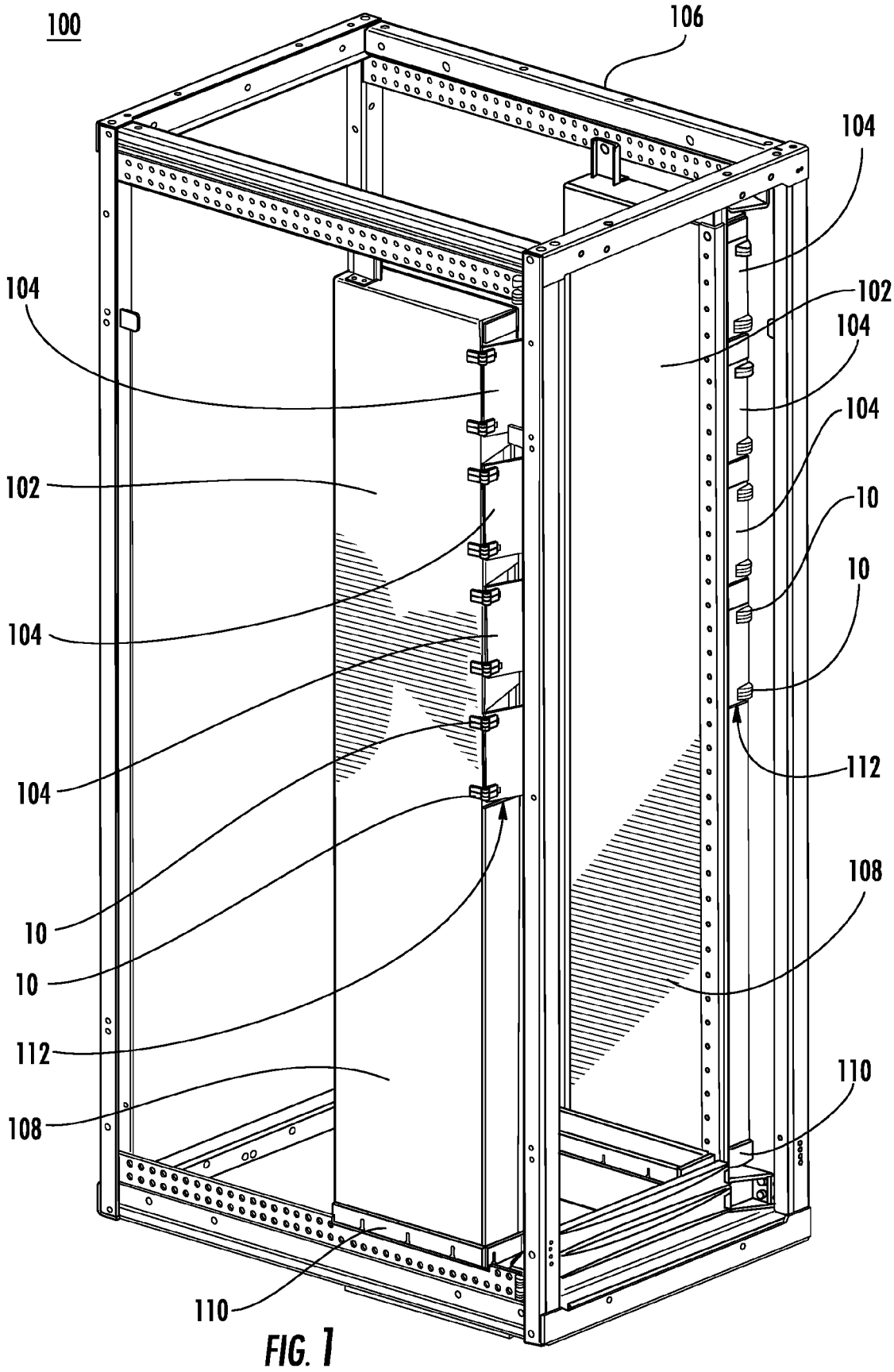
FIG. 1 is an isometric view of an electronic equipment enclosure installation, having an internal air duct with doors mounted using an indexing hinge, in accordance with a preferred embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is an isometric view of an electronic equipment enclosure installation 100, having an internal air duct 102 with doors 104 mounted thereto using an indexing hinge 10, in accordance with an exemplary embodiment of the present invention. As shown, the electronic equipment enclosure installation 100 typically includes an equipment enclosure 106 supported by a raised floor (not shown). The equipment enclosure 106 comprises a frame, conventionally formed from vertical and horizontal frame members, and may further include mounting rails (not shown), for supporting electronic equipment and related accessories, and one or more panels (not shown), which conventionally take the form of side panels, front and rear doors or panels, top panels, and bottom panels.

In use, electronic equipment (not shown) is installed in the equipment enclosure 106, typically by attaching the equipment to the mounting rails, and operated normally. Arranged inside the equipment enclosure 106 is an internal air duct 102 adapted to guide the flow of cool air from beneath the raised floor to various elevations within the enclosure 106.

Figure 2:
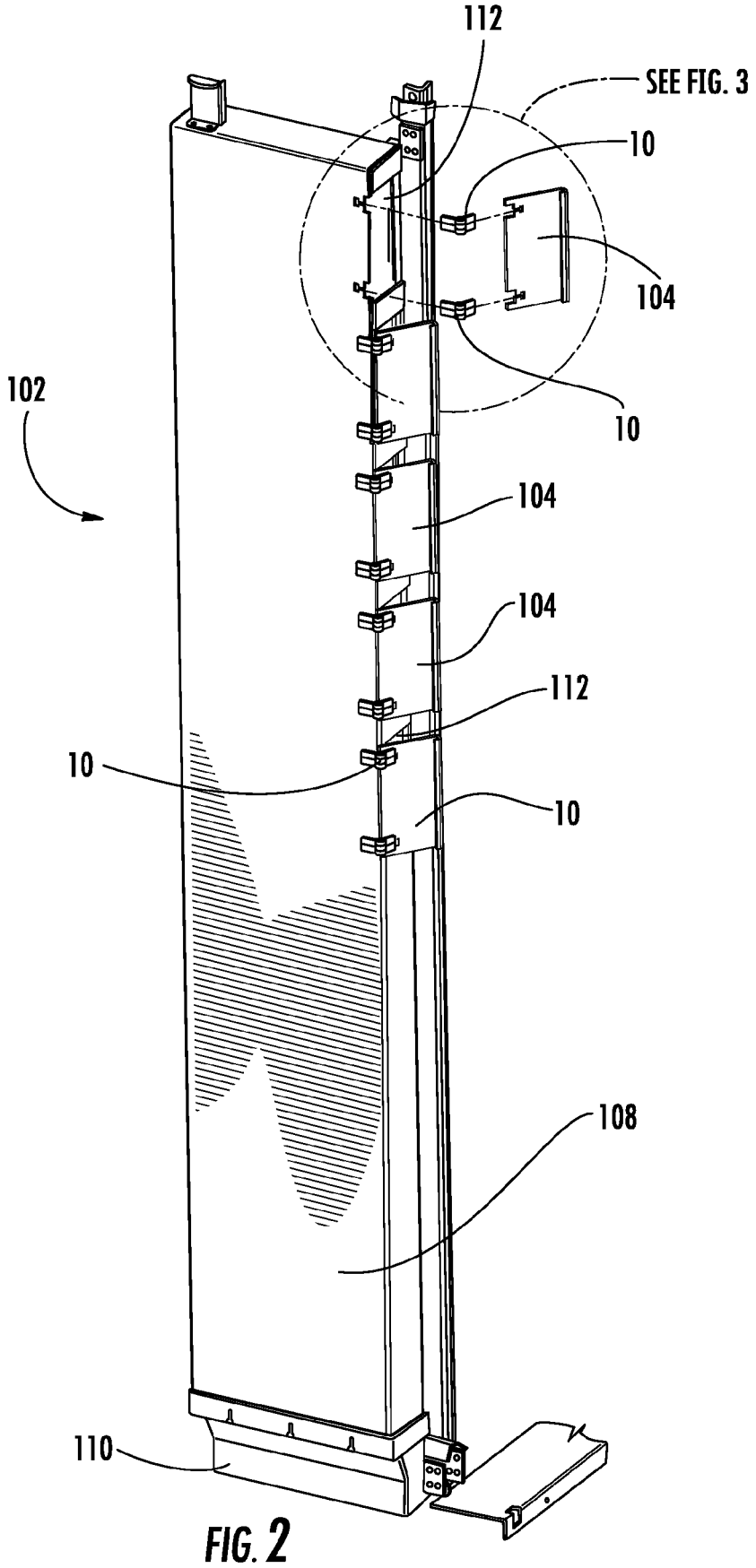
FIG. 2 is a partially exploded isometric view of one of the internal air ducts of FIG. 1.
Figure 3:
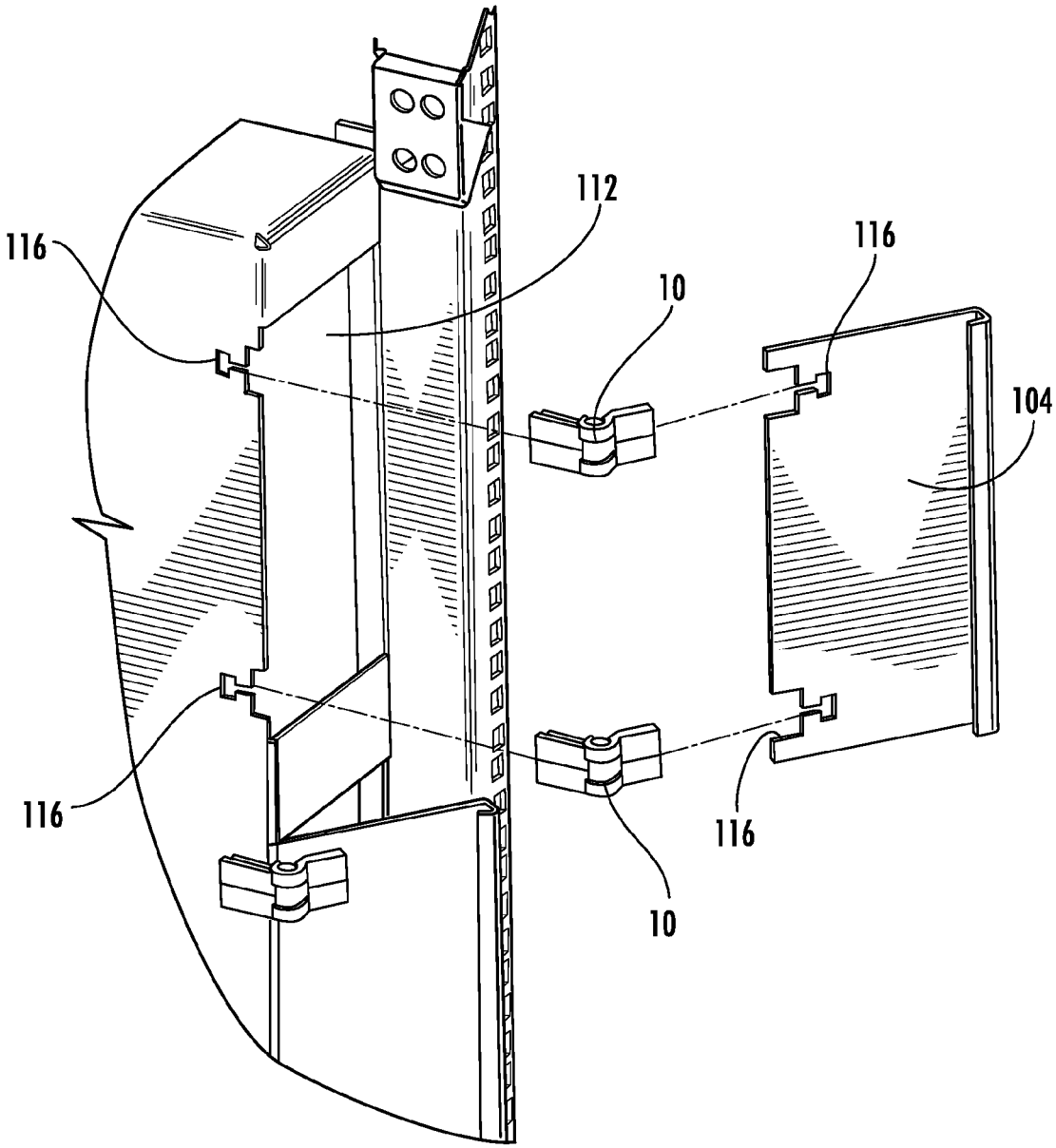
FIG. 3 is a detailed fragmentary exploded view of an upper port door of FIG. 2.

In the exemplary embodiment illustrated in FIGS. 1-3, the internal air duct 102 includes a pair of risers 108, each riser 108 extending vertically from a respective collector 110, and the two risers being connected at their upper ends by an air dam (not shown). Each riser 108 is of generally hollow, rectangular construction, with a solid top end and a bottom end that opens into a corresponding collector 110, and includes a plurality of distribution openings or ports 112 arranged along the front thereof. The internal air ducts 102 include ports 112 near the top of the risers 108. Each port 112 may be selectively closed and opened, or covered and uncovered, by a respective port door 104 mounted to one of the risers 108 by a pair of indexing hinges 10. The indexing hinges 10 of the present invention permit each door 104 to be opened and closed individually for selective cooling of electronic equipment stored in the electronic equipment enclosure 106. Additionally, the indexing hinges 10 provide a mechanism for partially opening or selectively positioning the doors 104 for further cooling selectability.

FIG. 2 is a partially exploded perspective view of one of the internal air ducts 102 of FIG. 1, and FIG. 3 is a detailed exploded view of an upper port door 104 of FIG. 2. As is shown, the doors 104 and the portions of the riser 108 to which the doors 104, and consequently the indexing hinges 10, will be mounted have a profile 116 (best shown in FIG. 3) cut therein so as to be able to accept the indexing hinge 10. The profile shape will be more fully understood when the structure of the indexing hinge 10 is described fully hereinbelow.

Figure 4:
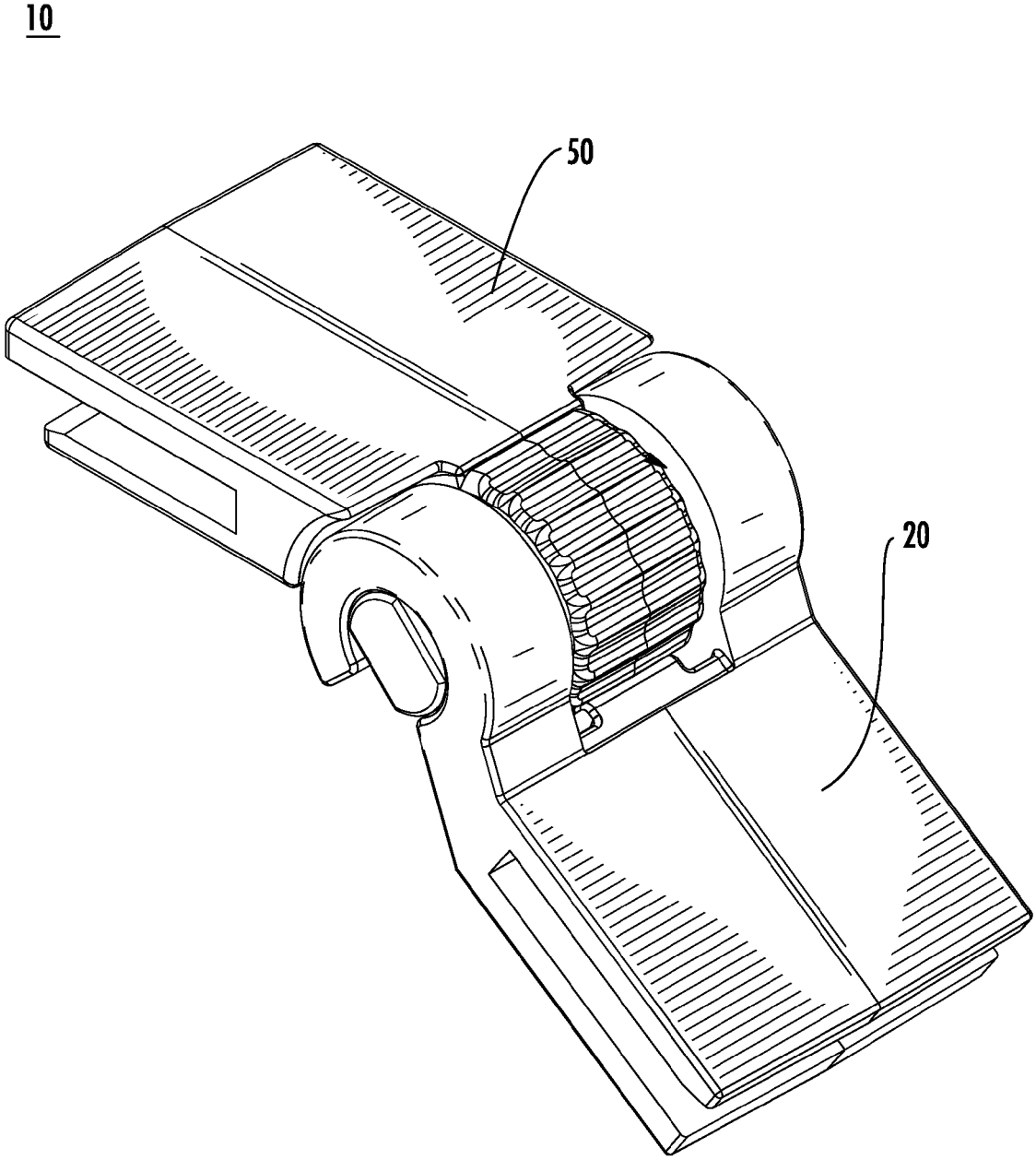
FIG. 4 is a top orthogonal view of an indexing hinge in accordance with the preferred embodiments of the present invention.

The hinges shown in FIGS. 4-21 are shown in a different orientation than the hinges shown in FIGS. 1-3. FIGS. 1-3 show one exemplary application of the hinges, wherein the hinges are in a particular orientation. It will be understood by the Ordinary Artisan that the hinges of the present invention may be used in any orientation. Further, relative terms such as top, bottom, side, and end are used for convenience and illustration with regard to FIGS. 4-21 and should not be considered limiting in any way on the invention. FIG. 4 is a top orthogonal view of an indexing hinge 10 in accordance with the preferred embodiments of the present invention. As shown therein, the indexing hinge 10 primarily includes two hinge halves 20, 50, referred to herein as a two arm hinge half 20 and an axle hinge half 50. These two elements 20, 50 are described below.

Figure 5:
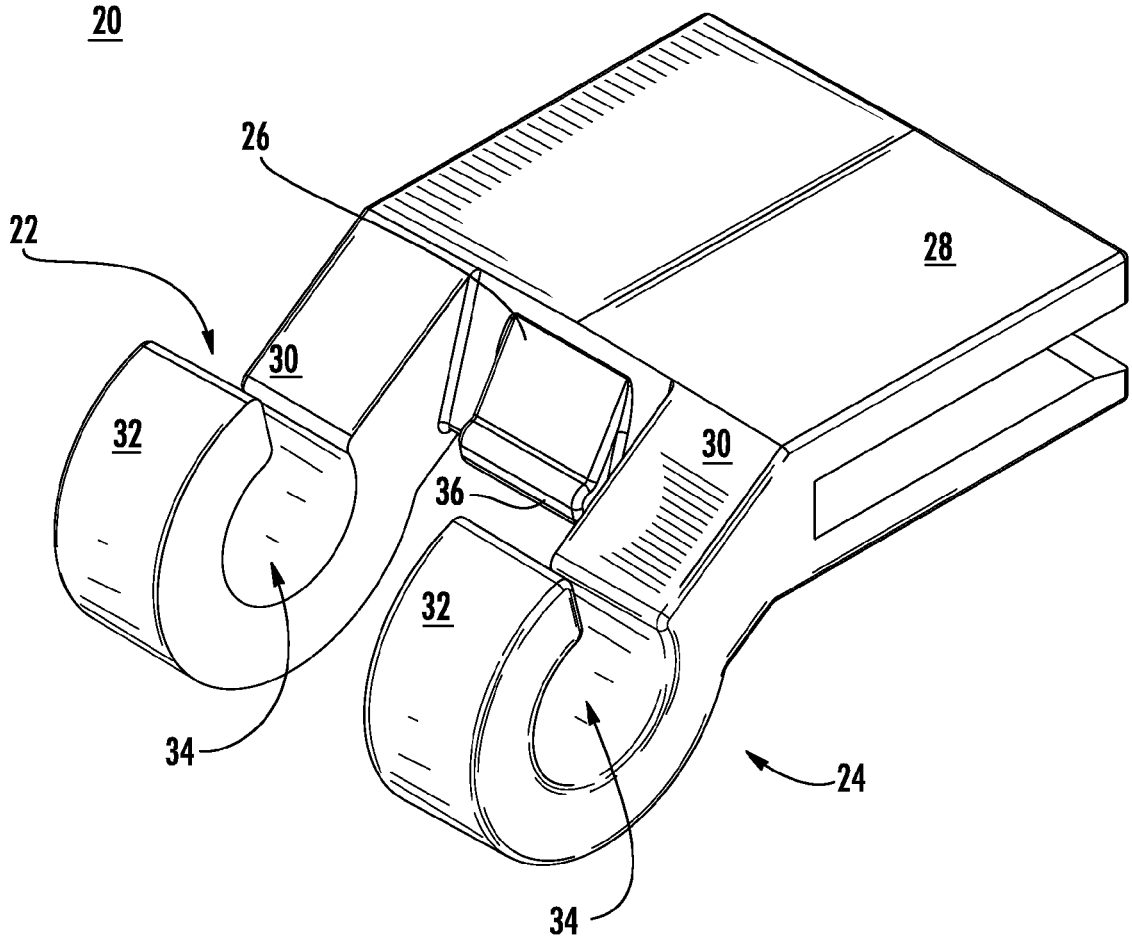
FIG. 5 is a bottom orthogonal view of the two arm hinge half of the indexing hinge of FIG. 4.
Figure 6:
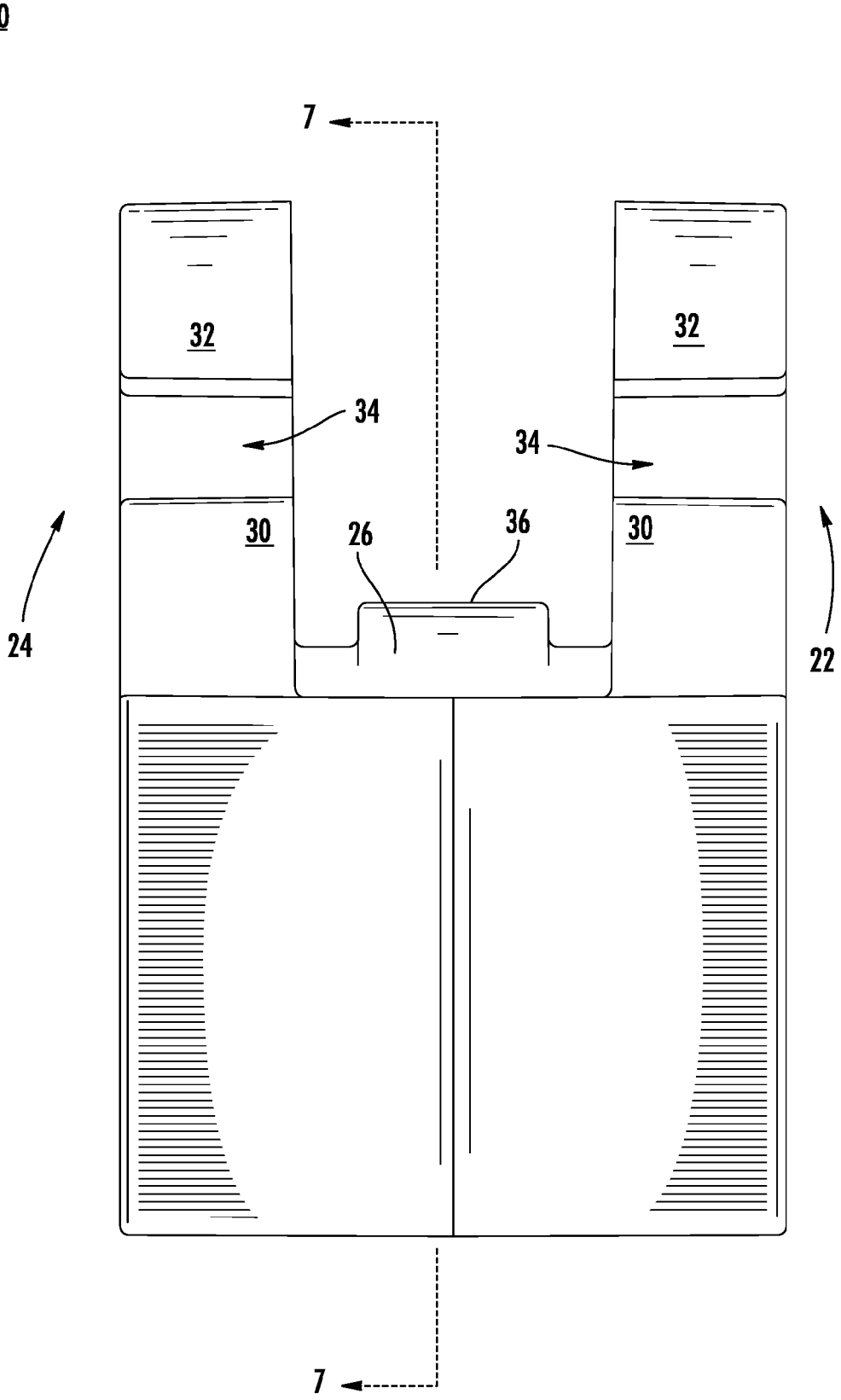
FIG. 6 is a bottom plan view of the two arm hinge half of FIG. 5.
Figure 7:
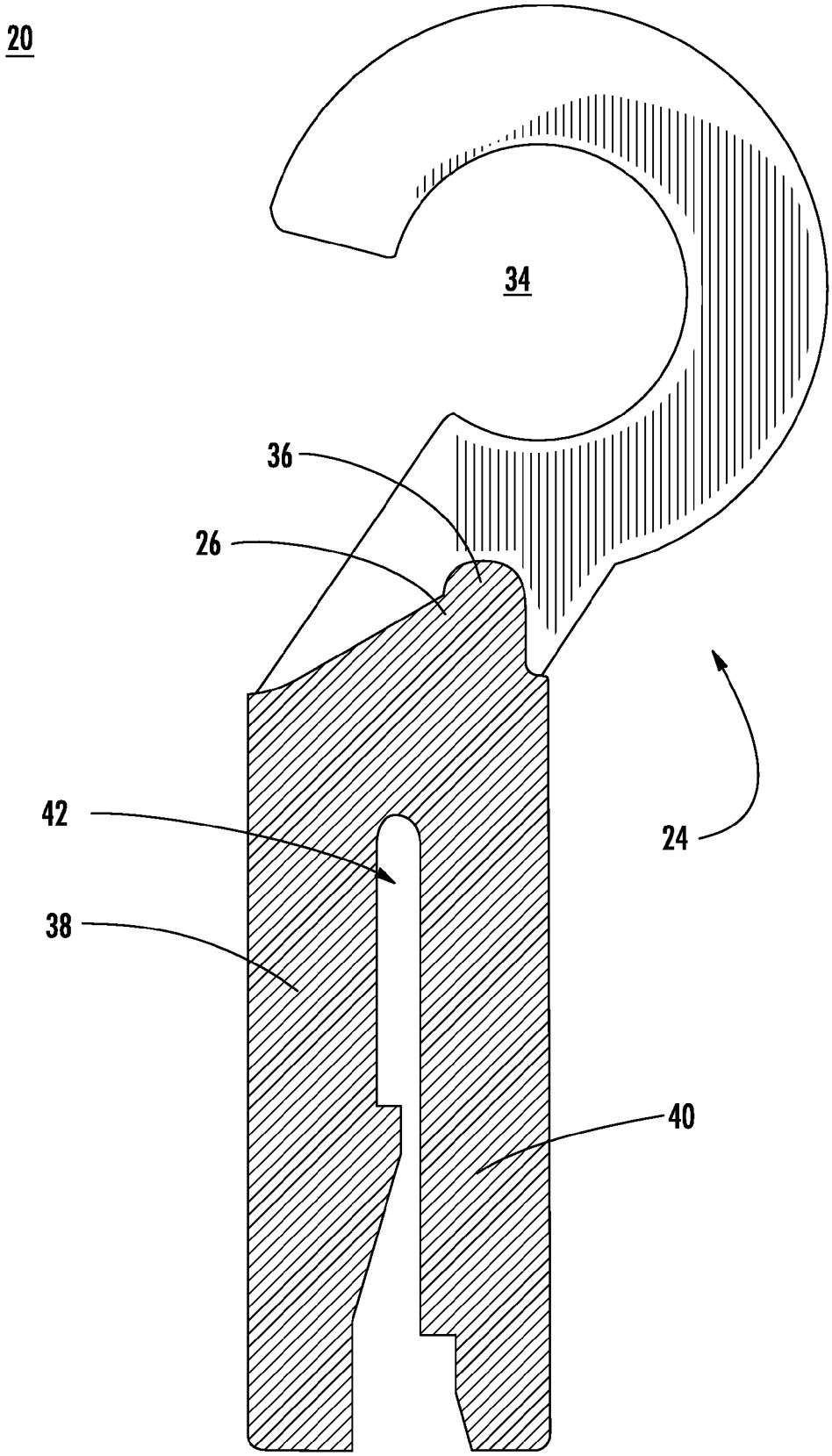
FIG. 7 is a side cross-sectional view of the two arm hinge half of FIG. 6, taken along line 7-7.

FIG. 5 is a bottom orthogonal view of the two arm hinge half 20 of the indexing hinge 10 of FIG. 1, while FIG. 6 is a bottom plan view of the two arm hinge half 20 of FIG. 5 and FIG. 7 is a side cross-sectional view of the two arm hinge half 20 of FIG. 6, taken along line 7-7. As collectively shown therein, the two arm hinge half 20 includes two hinge arms 22, 24, a projecting indexing element 26 and a first mounting element 28. The two hinge arms 22, 24, which are preferably symmetric with respect to each other, each include a base section 30 extending from a proximal end of the mounting element 28 and an approximately arcuate hinge barrel section 32 extending from an end of the base section 30 opposite the mounting element 28. Each base section 30 is preferably offset from the body of the mounting element 28, and is sloped along the upper and lower surface to permit maximum rotation of the axle hinge half 50 as described hereinbelow. Each hinge barrel section 32 defines a partially-enclosed opening 34 of substantially cylindrical cross-section, and the two hinge barrel sections 32 are aligned such that the cylindrical openings 34 are collinear.

The projecting indexing element 26 is preferably disposed halfway between the two hinge arms 22, 24 and comprises a short protrusion with a rounded or beveled tip 36 extending from the proximal end of the mounting element 28. Though not absolutely necessary, it is further preferable that the distance from the tip 36 to the center of the cylindrical openings 34 is greater than the radius of the cylindrical openings 34 and is arranged to interact with teeth 60 and detents 62 of an indexing element 56 on the axle hinge half 50, as described below.

Figure 8:
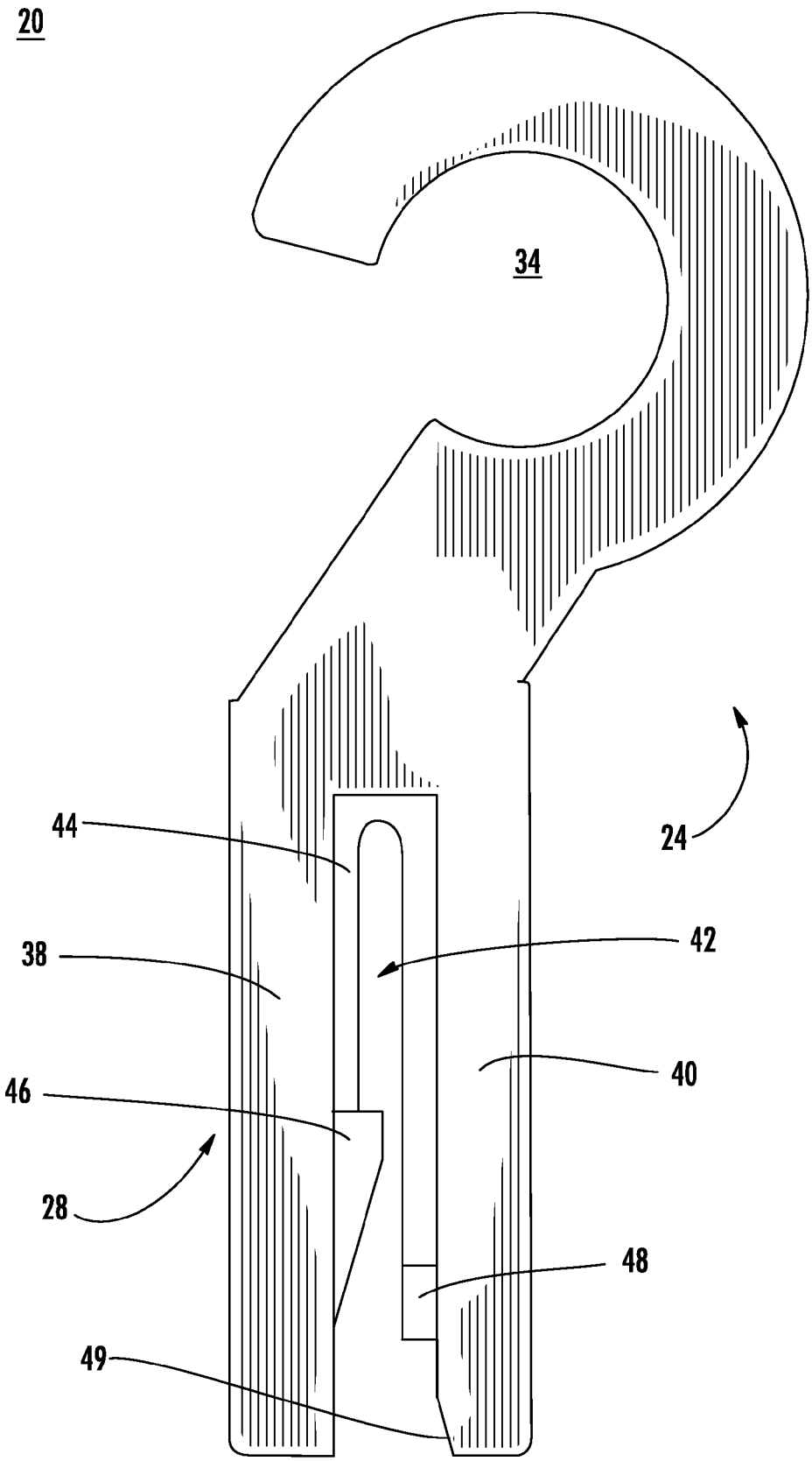
FIG. 8 is a side plan view of the two arm hinge half of FIG. 5.
Figure 9:
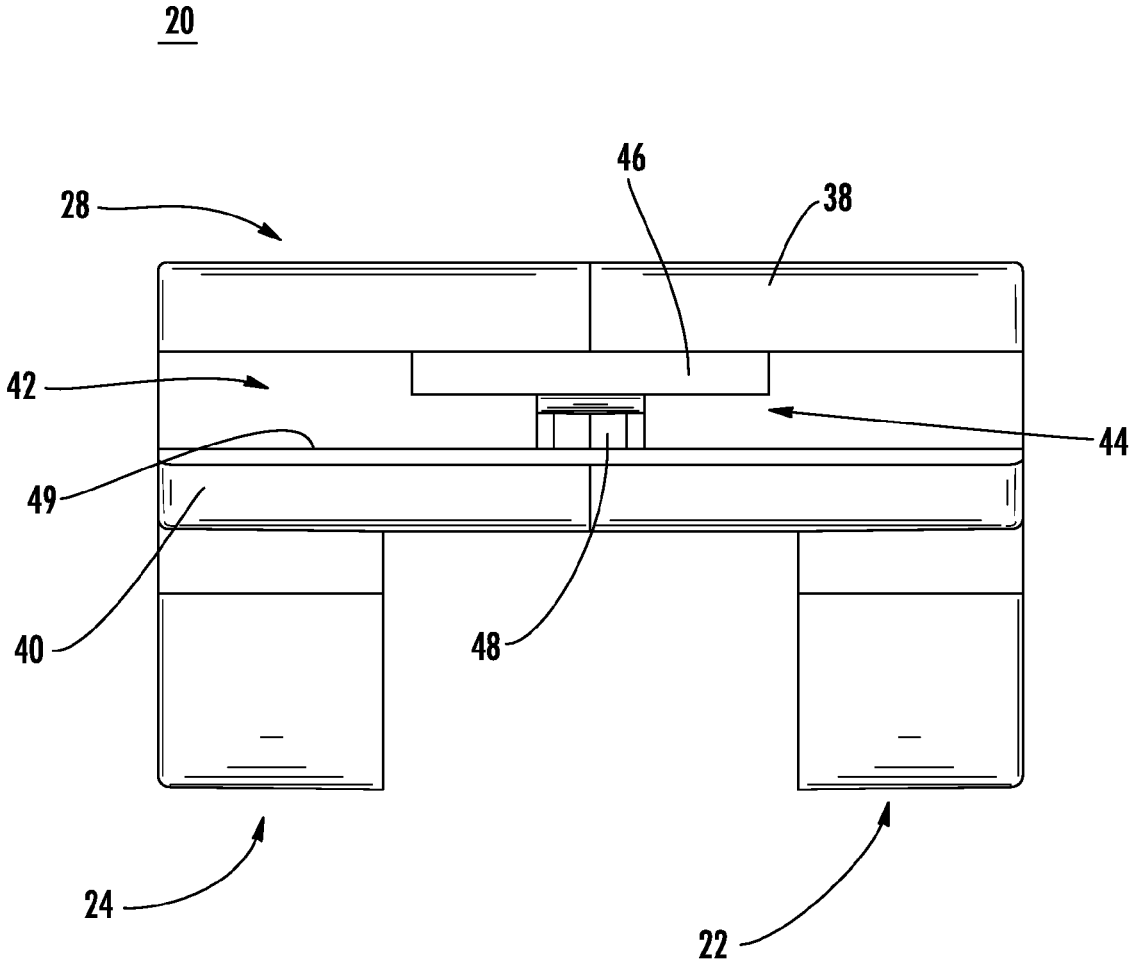
FIG. 9 is an end plan view of the two arm hinge half of FIG. 5.

FIGS. 8 and 9 are a side plan view and an end plan view, respectively, of the two arm hinge half 20 of FIG. 5. As shown in FIGS. 7-9, the mounting element 28 includes a first mounting section 38 and a second mounting section 40 separated by a slot 42. Disposed within the slot 42 is a U-shaped structure 44. At the end of the U-shaped structure 44 adjacent the first mounting section 38 is disposed a ramped structure 46 arranged to face into the slot 42, and at the end of the U-shaped structure 44 adjacent the second mounting section 40 is disposed a tapered structure 48, also arranged to face into the slot 42 in opposition to the ramped structure 46. Further, extending along the entire length of the edge of the second mounting section 40 at the end of the slot 42 is a beveled surface 49. The ramped structure 46, the tapered structure 48 and the beveled surface 49 all aid in mounting the two arm hinge half 20 to a door, other panel, wall or other planar structure 90, 95 (perhaps best seen in FIG. 20) by forcing the first and second mounting sections 38, 40 apart or otherwise guiding the two arm hinge half 20 into place on the planar structure 90, 95 before snapping into place in a correspondingly-sized and -located slot on the planar structure 90, 95, as will be apparent to the Ordinary Artisan.

Figure 10:
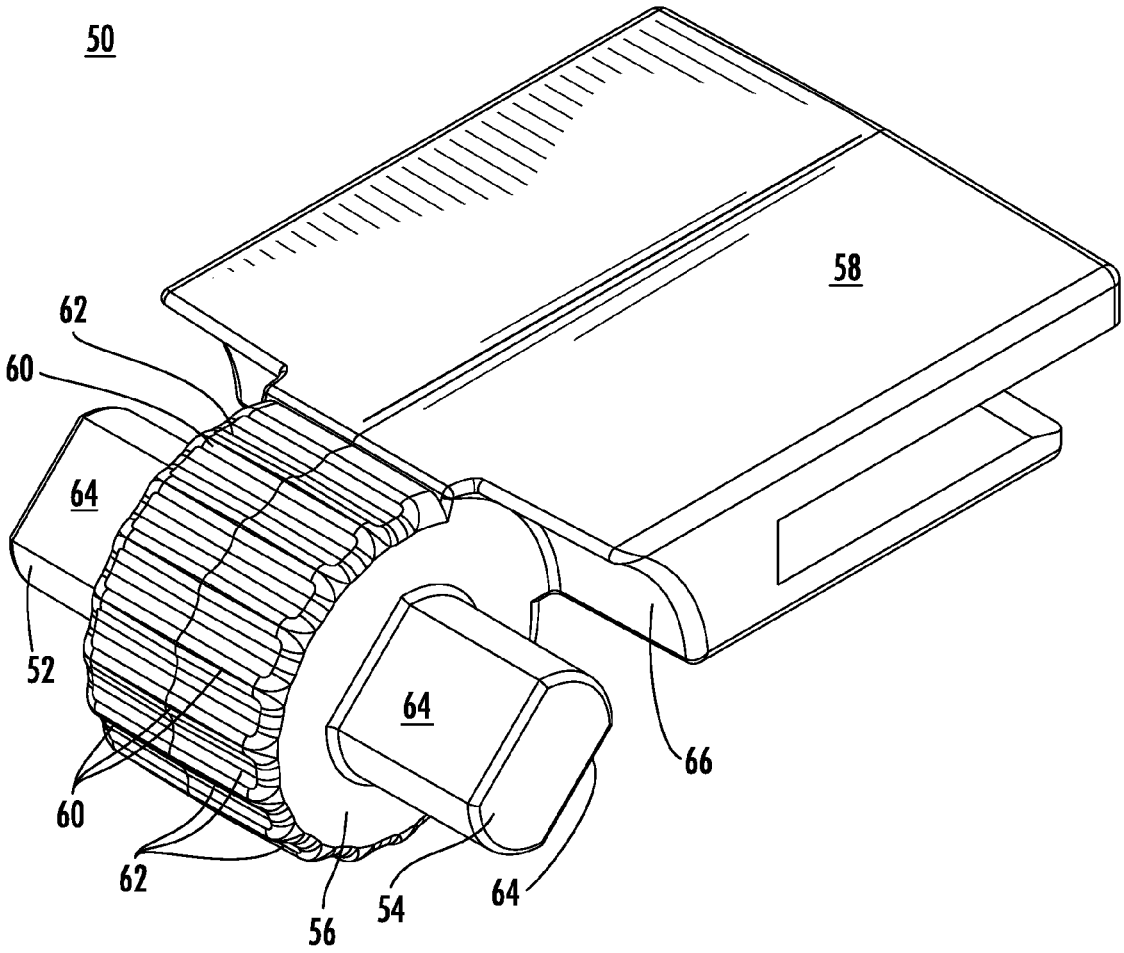
FIG. 10 is a top orthogonal view of the axle hinge half of the indexing hinge of FIG. 4.
Figure 11:
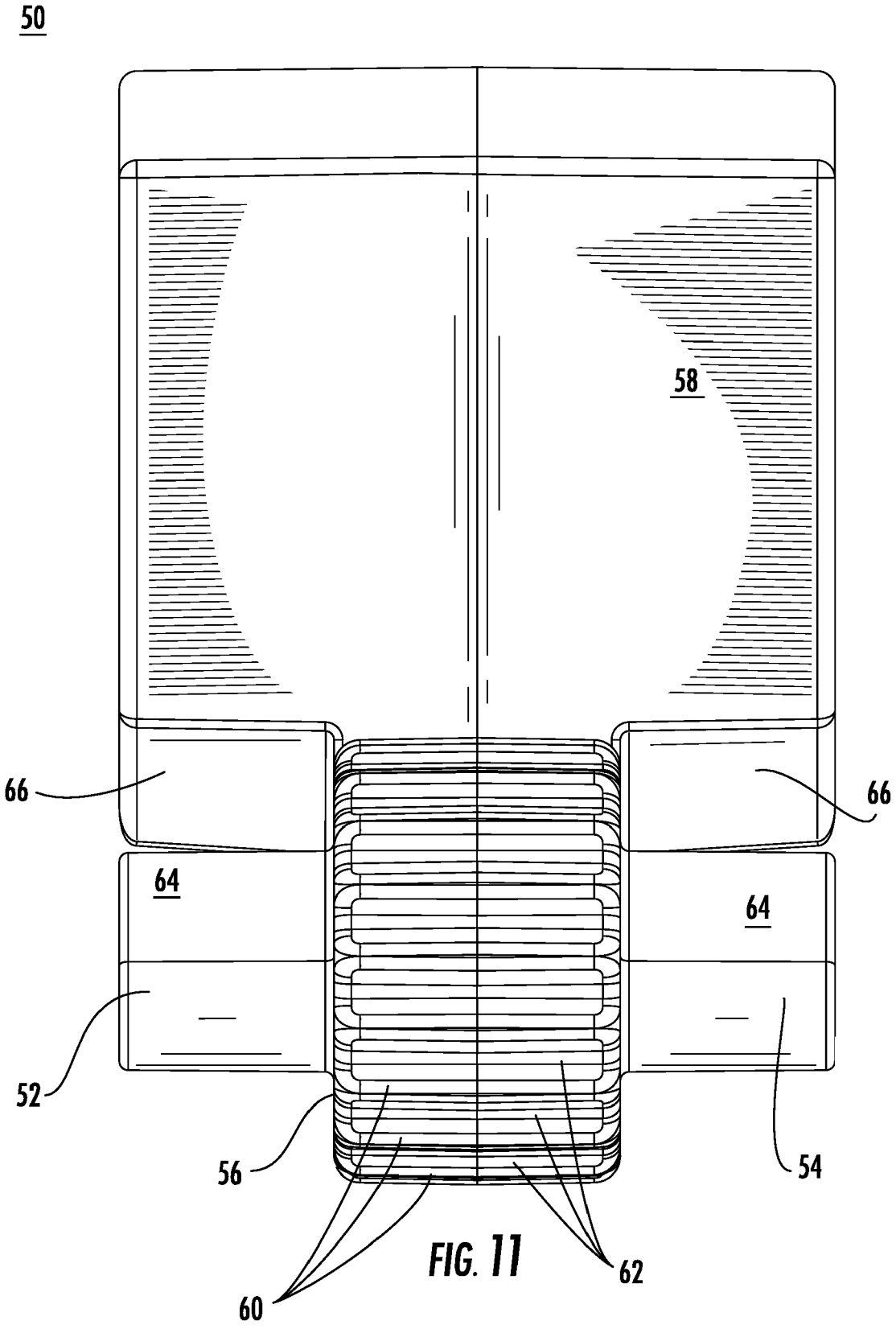
FIG. 11 is a bottom plan view of the axle hinge half of FIG. 10.
Figure 12:
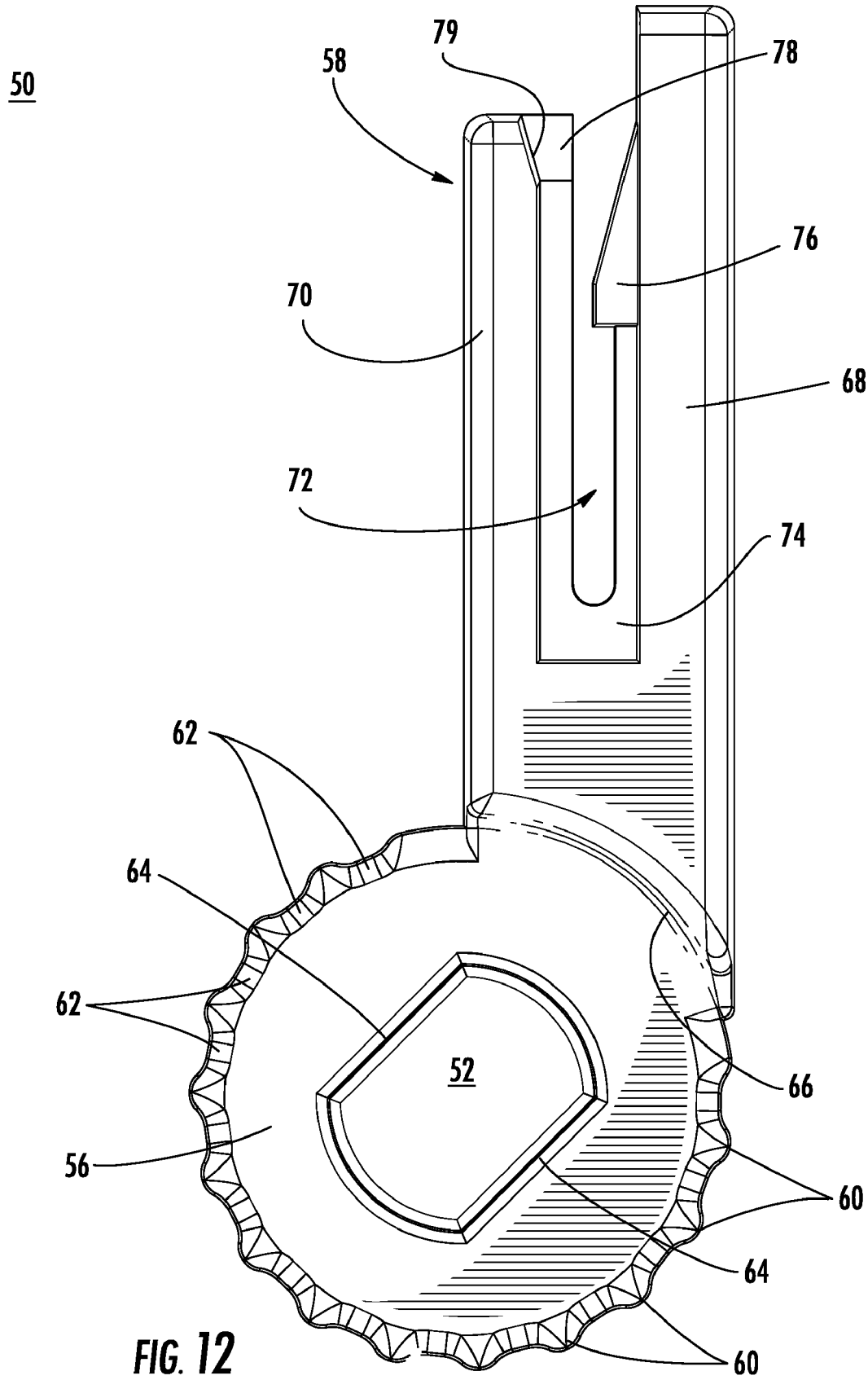
FIG. 12 is a side plan view of the axle hinge half of FIG. 10.

FIG. 10 is a top orthogonal view of the axle hinge half 50 of the indexing hinge 10 of FIG. 4, while FIG. 11 is a bottom plan view of the axle hinge half 50 of FIG. 10 and FIG. 12 is a side plan view of the axle hinge half 50 of FIG. 10. As collectively shown therein, the axle hinge half 50 includes two flat-sided axles 52, 54, each extending from a toothed indexing element 56, and a second mounting element 58. As perhaps best shown in FIG. 12, the toothed indexing element 56 is formed in the shape of a nearly complete cylinder extending from a proximal end of the mounting element 58 such that the axis of the cylinder generally parallels the proximal end of the mounting element 58. Except for where the cylinder intersects the proximal end of the mounting element 58, the curved surfaces of the cylinder are covered with a plurality of teeth 60, each extending generally from one cylinder base to the other and defining a plurality of detents 62 therebetween. The purpose and operation of these teeth 60 and the detents 62 they define will be made apparent hereinbelow.

The two axles 52, 54, which are preferably symmetric with respect to each other, each comprise a portion of a cylinder having opposing flat, parallel faces 64. The diameter of the cylinder and the orientation and size of the flat faces 64 are each selected to correspond with the size and arrangement of the openings 34 of the two arm hinge half 20 and other aspects of the hinge arms 22, 24, as will be further described hereinbelow.

Figure 13:
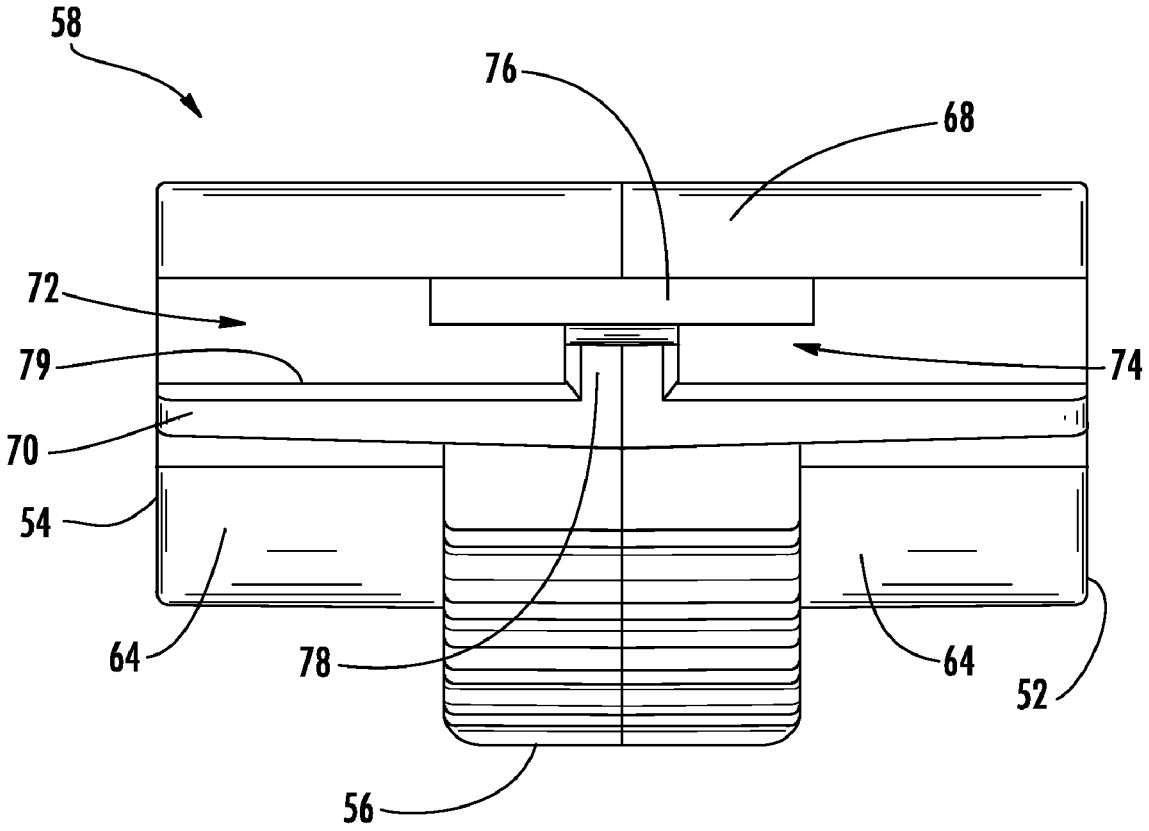
FIG. 13 is an end plan view of the two arm hinge half of FIG. 10.

FIG. 13 is an end plan view of the axle hinge half 50 of FIG. 10. As shown in FIGS. 12 and 13, the mounting element 58 includes a first mounting section 68 and a second mounting section 70 separated by a slot 72. Disposed within the slot 72 is a U-shaped structure 74. At the end of the U-shaped structure 74 adjacent the first mounting section 68 is disposed a ramped structure 76 arranged to face into the slot 72, and at the end of the U-shaped structure 74 adjacent the second mounting section 70 is disposed a tapered structure 78, also arranged to face into the slot 72 in opposition to the ramped structure 76. Further, extending along the entire length of the edge of the second mounting section 70 at the end of the slot 72 is a beveled surface 79. The ramped structure 76, the tapered structure 78 and the beveled surface 79 all aid in mounting the axle hinge half 50 to a door, other panel, wall or other planar structure 90, 95 by forcing the first and second mounting sections 68, 70 apart or otherwise guiding the axle hinge half 50 into place on the planar structure 90, 95 before snapping into place in a correspondingly-sized and -located slot on the planar structure 90, 95, as will be apparent to the Ordinary Artisan.

In addition, the proximal end of the mounting element 58 includes concave surfaces 66 disposed on either side of the indexing element 56, as perhaps best shown in FIG. 10. The curvature of each concave surface 66 is selected to be generally cylindrical in form, the axis of such cylinder being generally coincident with the axis defining the cylinder of the indexing element 56 and the flat-sided axles 52, 54. This concave surface permits free rotation of the two hinge arms 22, 24 of the two arm hinge half 20 as more fully described hereinbelow.

Figure 14:
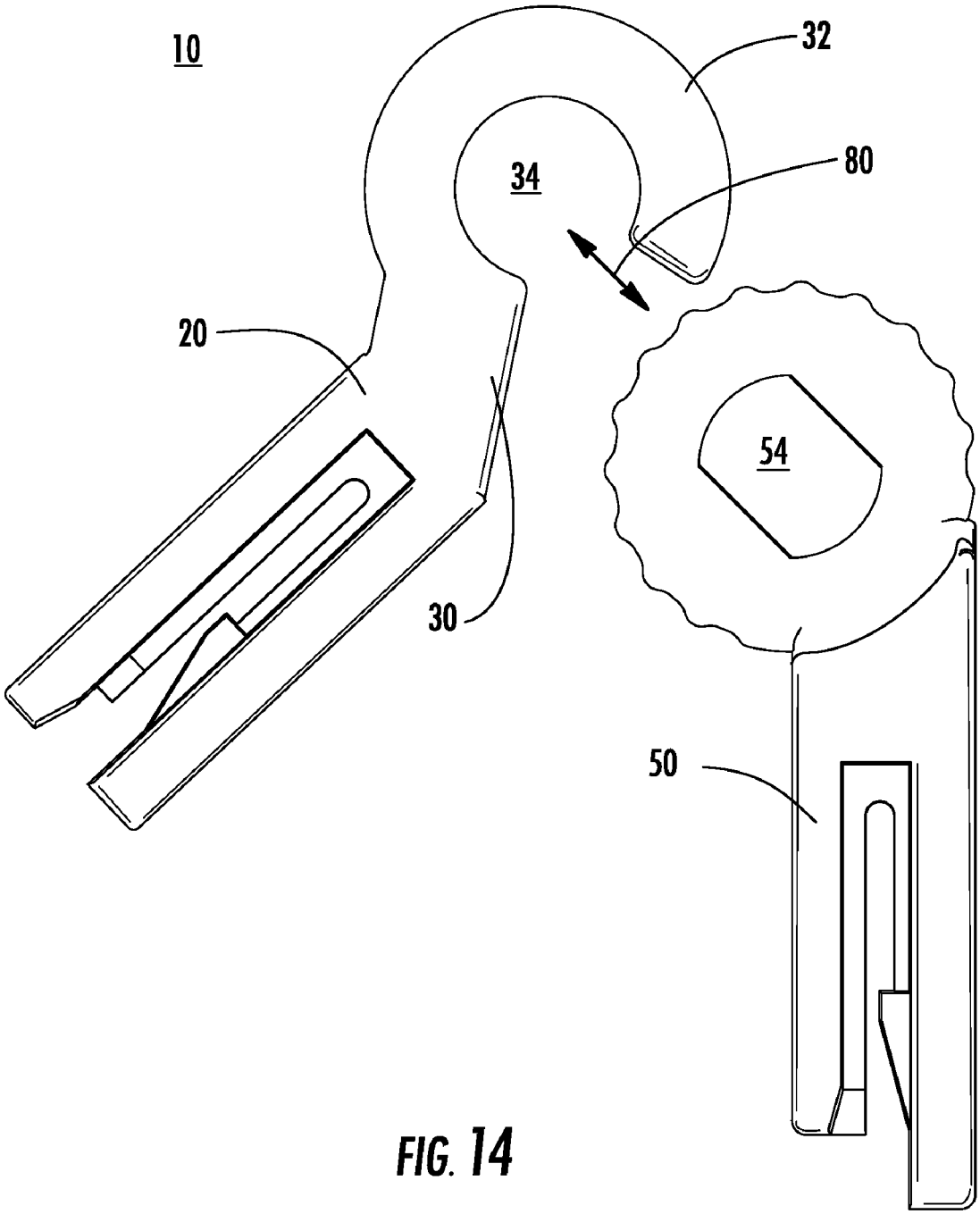
FIG. 14 is a side plan view of the indexing hinge of FIG. 4, shown in a disassembled state.

FIG. 14 is a side plan view of the indexing hinge 10 of FIG. 4, shown in a disassembled state. As illustrated therein, the two halves 20, 50 may be connected together by aligning the flat-sided axles 52, 54 with the openings 34 in the hinge barrel sections 32, and more particularly, by aligning the flat-sided axles 52, 54 with the gap between the free ends of the hinge barrel sections 32 and the respective hinge arm base sections 30. Once aligned, the halves 20, 50 may be interconnected by pressing them together along the lines of force represented by the arrow 80 in FIG. 14. With a sufficient amount of force, the barrel sections 32 may be forced away from the base sections 30 by a distance sufficient to permit the axles 52, 54 to pass into the openings 34, at which point the barrel sections 32 return to the original positions, thereby retaining the axles 52, 54 in the openings 34.

Figure 15:
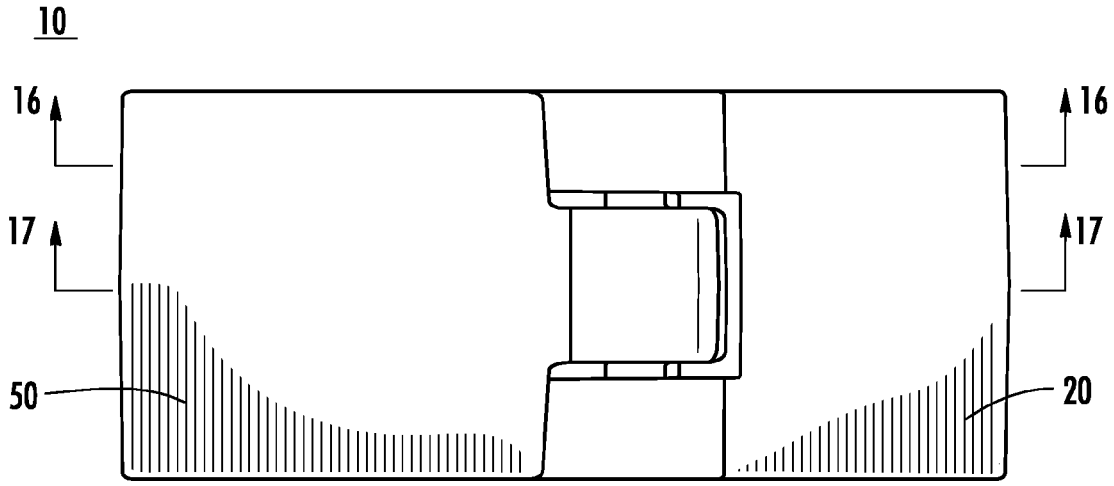
FIG. 15 is a top plan view of the indexing hinge of FIG. 4.
Figure 16:
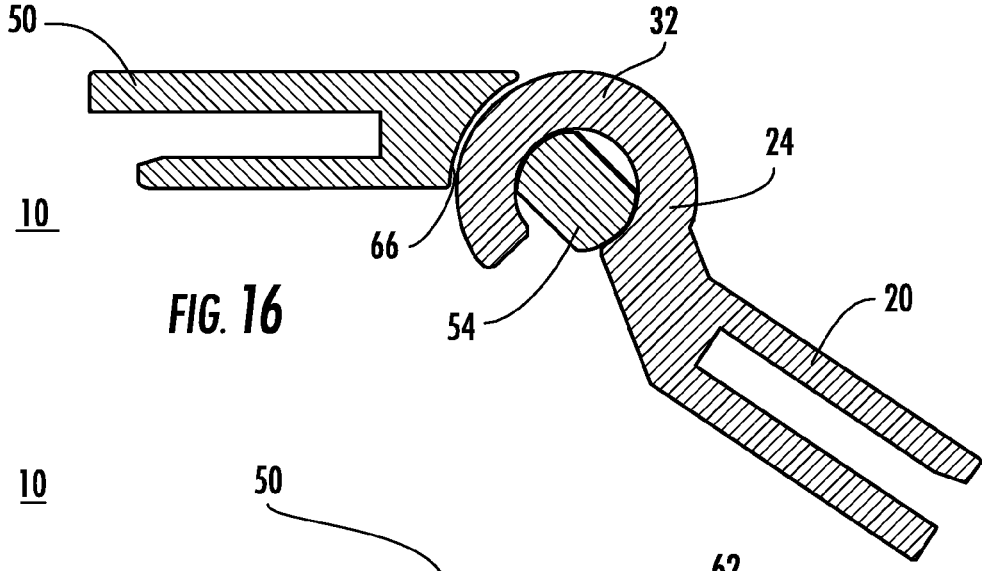
FIG. 16 is a side cross-sectional view of the indexing hinge of FIG. 15, taken along line 16-16.
Figure 17:
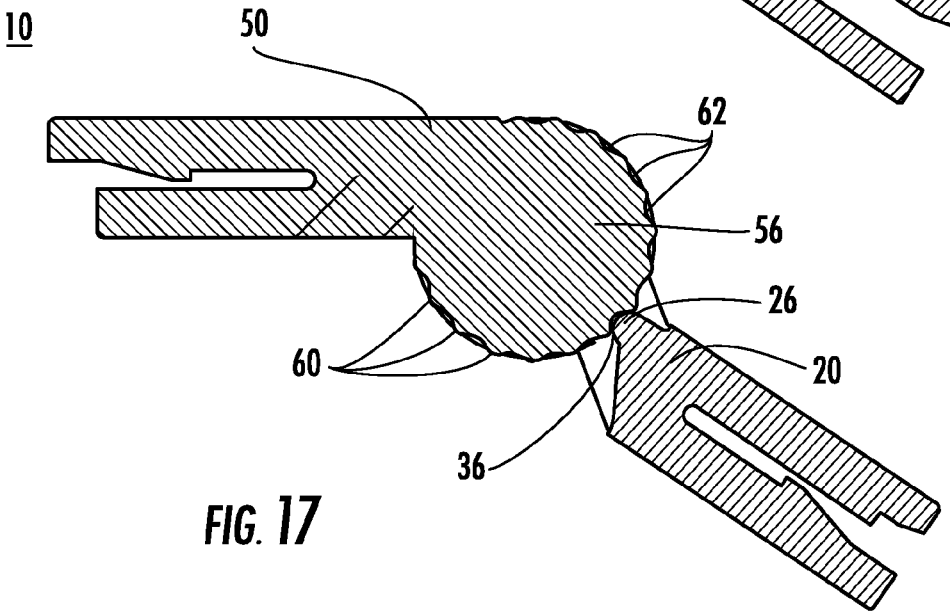
FIG. 17 is a side cross-sectional view of the indexing hinge of FIG. 15, taken along line 17-17.

The assembled hinge 10 is shown in FIGS. 15-17, wherein FIG. 15 is a top plan view of the indexing hinge 10 of FIG. 4, while FIG. 17 is a side cross-sectional view of the indexing hinge 10 of FIG. 15, taken along line 17-17, and FIG. 17 is a side cross-sectional view of the indexing hinge 10 of FIG. 15, taken along line 17-17. FIG. 16 perhaps best illustrates the retention of the axles 52, 54 in the openings 34, as well as the relationship of the outer surfaces of the barrel sections 32 to the concave surfaces 66 of the axle hinge half 50. As evidenced therein, the interconnection of the hinge arms 22, 24 of the first hinge half 20 to the axles 52, 54 of the second hinge half 50 permit the two halves 20, 50 to rotate with respect to each other about an axis defined by the axles 52, 54.

Significantly, however, free rotation of the two hinge halves 20, 50 is restricted through the use of the two indexing elements 26, 56. As perhaps best shown in FIG. 17, the tip 36 of the projecting indexing element 26 is arranged to interact with the teeth 60 and detents 62 of the indexing element 56 on the axle hinge half 50. More specifically, as one of the hinge halves 20, 50 is rotated relative to the other, the teeth 60 tend to bias the tip 36 into one of the detents 62 defined therebetween. Thus, in order to cause the tip 36 to move from one detent 62 to another, an extra amount of force, over and above that required to cause rotation by itself, is necessary in order to overcome the biasing force applied by the teeth 60 adjacent the current detent 62. This minimum force is such that once the hinge halves 20, 50 are placed in a particular rotational disposition, relative to each other, they are predisposed to remain in that position until a user once again applies the minimum force in order to cause rotation. This feature of the indexing hinge enables the hinge to maintain its selective positioning against external forces such as the force of flowing air, e.g., if the hinge 10 is being used to mount a door to an internal air duct 102 as shown in FIGS. 1-3, or if the hinge 10 is being used on an air conditioning vent (not shown). In this regard, it is preferable, though not necessary, that the distance from the tip 36 to the center of the cylindrical openings 34 is greater than the radius of the cylindrical openings 34, thereby facilitating the application of a greater amount of torque by the tip 36 on the axle hinge half 50.

Figure 18:
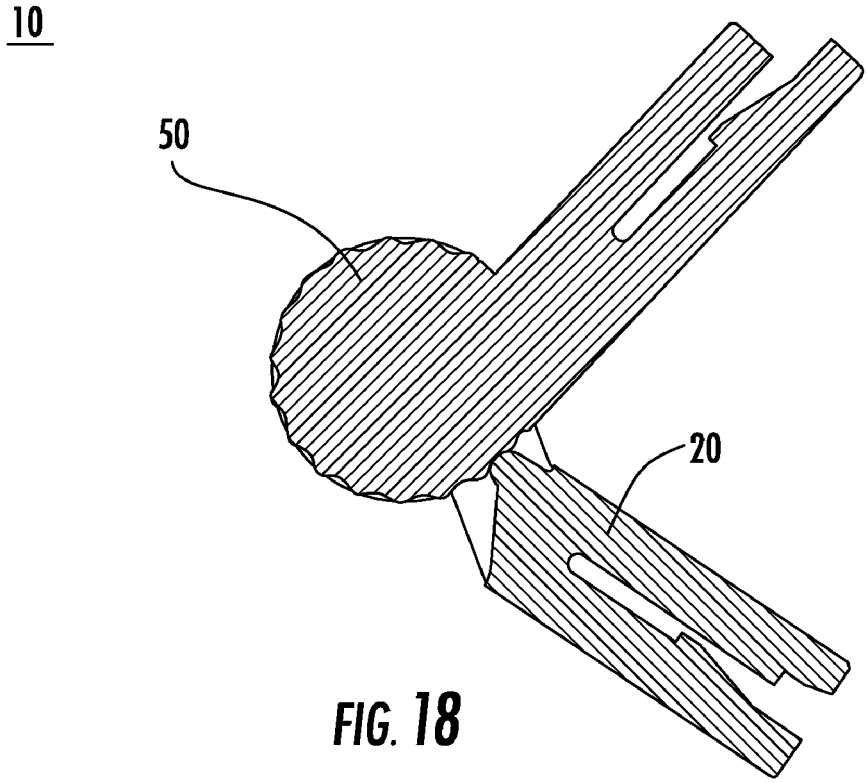
FIG. 18 is a side cross-sectional view of the indexing hinge of FIG. 17, but with the hinge in a first alternative rotational state.
Figure 19:
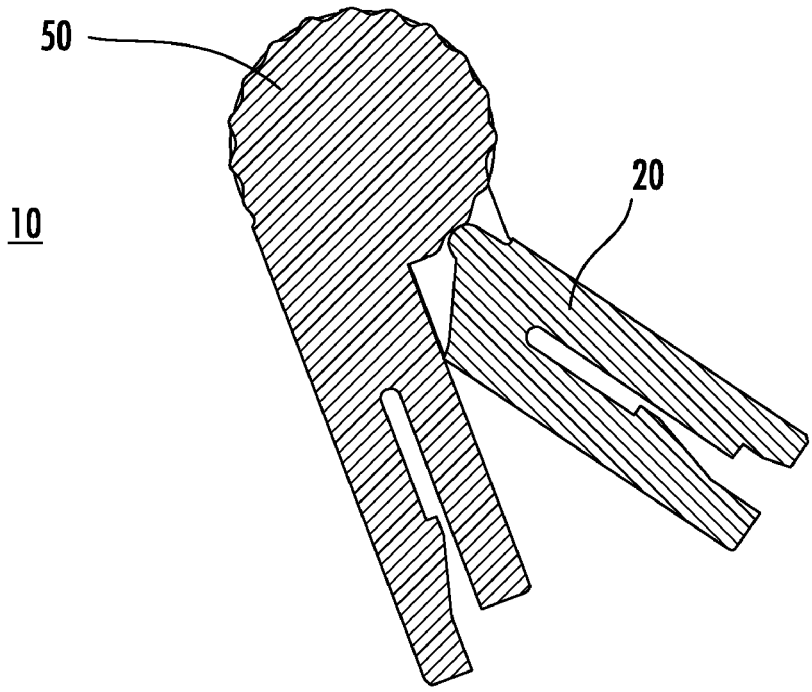
FIG. 19 is a side cross-sectional view of the indexing hinge of FIG. 17, but with the hinge in a second alternative rotational state.

FIG. 18 is a side cross-sectional view of the indexing hinge 10 of FIG. 17, but with the hinge 10 in a first alternative rotational state. FIG. 19 is a side cross-sectional view of the indexing hinge 10 of FIG. 17, but with the hinge 10 in a second alternative rotational state. Together, FIGS. 18 and 19 demonstrate the full range of rotation of the two arm hinge half 20 relative to the axle hinge half 50.

Figure 20:
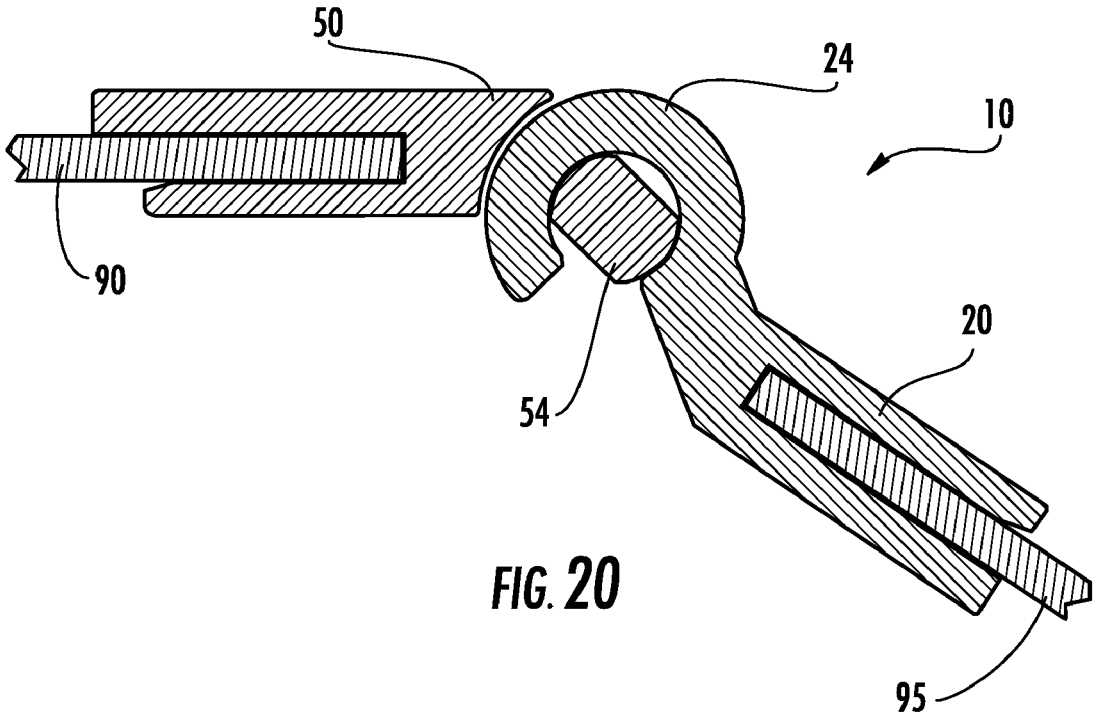
FIG. 20 is a side cross-sectional view similar to that of FIG. 16, wherein the indexing hinge is shown in an installed state.
Figure 21:
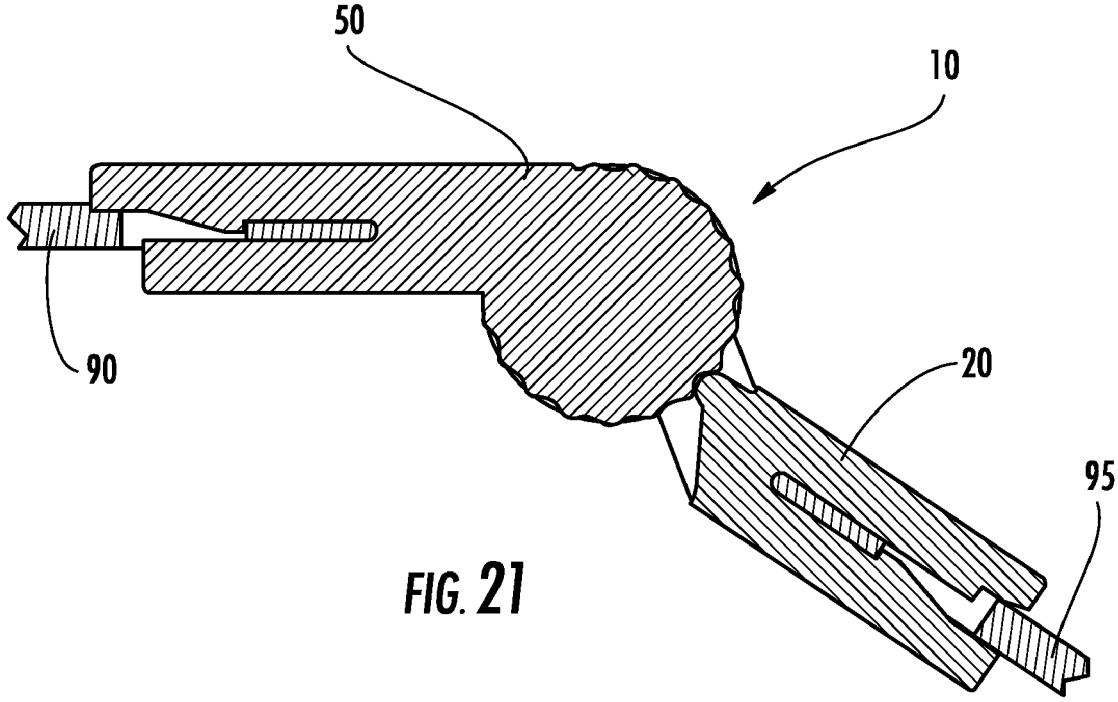
FIG. 21 is a side cross-sectional view similar to that of FIG. 17, wherein the indexing hinge is shown in the installed state.

FIG. 20 is a side cross-sectional view similar to that of FIG. 16, wherein the indexing hinge 10 is shown in an installed state. FIG. 21 is a side cross-sectional view similar to that of FIG. 17, wherein the indexing hinge 10 is shown in the installed state. As stated previously, the installation of the indexing hinge 10 on doors, other panels, walls or other planar structures 90, 95 will be apparent to the Ordinary Artisan.

Both halves 20, 50 of the hinge 10 may be molded from a suitable plastic material. The single integral indexing feature of the two arm hinge halve 20 is designed to provide a slight interference fit against the mating multiple integral indexing teeth of the axle hinge half 50. By virtue of the material composition and the "split" design of the hinge arms 22, 24, a sufficient compliance exists to permit the two hinge arms 22, 24 to act as a spring and extend and contract slightly as the indexing features 26, 56 interfere with one another as the hinge components 20, 50 are rotated. The compliance of the hinge arms 22, 24 further allows the hinge assembly 10 to hold the indexing features 26, 56 together at known, repeatable positions with sufficient force to prevent rotation unless a moderate amount of rotational torque is applied. As disclosed and described, the hinge 10 is particularly intended for use with small doors, and more particularly with doors found on electronic equipment cabinets of the general kind described in commonly-assigned U.S. patent application Ser. No. 11/625,716, the entirety of which is incorporated herein by reference. The embodiment shown may be particularly suitable for a sheet metal door design, but other applications will be obvious to the Ordinary Artisan.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. An electronic equipment enclosure installation, comprising (a) an electronic equipment enclosure, including a first structure and a second structure, at least one of which is a door structure against which air is directed, and (b) an indexing hinge rotatably supporting the door structure, comprising:

(i) a two arm hinge half, including two hinge arms, a projecting indexing element disposed therebetween, and a first mounting element adapted to mount and connect the two arm hinge half to the first structure of the electronic equipment enclosure; and (ii) an axle hinge half, including two axles, each extending from a toothed indexing element, and a second mounting element adapted to mount and connect the axle hinge half to the second structure of the electronic equipment enclosure;

(iii) wherein when the axle hinge half is connected to the two arm hinge half by interconnecting each axle with a respective hinge arm, the projecting indexing element abuts the toothed indexing element in such a way as to prevent rotation of the door structure, when air is directed against the door structure, unless an additional rotational torque is applied;

(c) wherein the door structure may be selectively positioned to control the flow of air in the electronic equipment enclosure; and (d) wherein the door structure and the indexing hinge are both entirely disposed within an interior of the electronic equipment enclosure.

2. The electronic equipment enclosure installation of claim 1, wherein each axle has two flat surfaces arranged therein to permit interconnection of the axle to a respective hinge arm.

3. The electronic equipment enclosure installation of claim 1, wherein the toothed indexing element is formed in the shape of a nearly complete cylinder and extends from a proximal end of the second mounting element such that the axis of the cylinder generally parallels the proximal end of the mounting element.

4. The electronic equipment enclosure installation of claim 3, wherein the cylinder defines curved surfaces and two bases, wherein the toothed indexing element includes a plurality of teeth covering the curved surfaces of the cylinder, and wherein the teeth extend generally from one cylinder base to the other and define a plurality of detents therebetween.

5. The electronic equipment enclosure installation of claim 1, wherein the projecting indexing element includes a short protrusion with a rounded or beveled tip that abuts the toothed indexing element in such a way as to prevent rotation unless an additional rotational torque is applied.

6. The electronic equipment enclosure installation of claim 1, wherein the two hinge arms each include an approximately arcuate hinge barrel section for interconnection with a respective axle.

7. The electronic equipment enclosure installation of claim 6, wherein each hinge barrel section defines a partially-enclosed opening of substantially cylindrical cross-section, and the two hinge barrel sections are aligned such that the cylindrical openings are collinear.

8. The electronic equipment enclosure installation of claim 7, wherein a distance from a tip of the projecting indexing element to a center of the cylindrical openings is greater than a radius of the cylindrical openings and wherein the tip of the projecting indexing element is arranged to interact with the toothed indexing element in such a way as to prevent rotation unless an additional rotation torque is applied.

9. The electronic equipment enclosure installation of claim 1, wherein the first mounting element and the second mounting element each include a first mounting section and a second mounting section separated by a slot, wherein a U-shaped structure is disposed.

10. The electronic equipment enclosure installation of claim 9, wherein the U-shaped structure includes a ramped structure and a tapered structure disposed in opposing facing relation to one another to aid in mounting the corresponding hinge half to a door, wall or other planar structure.

11. The electronic equipment enclosure installation of claim 1, wherein the hinge arms act as a spring by extending and contracting slightly as the projecting indexing element and toothed indexing element interact with one another when the additional rotational torque is applied to the indexing hinge to cause rotation thereof.

12. The electronic equipment enclosure installation of claim 1, wherein the door structure is a panel adapted to redirect air toward the other of the first and second structures when the air is directed toward the door structure; and wherein the projecting indexing element abuts the toothed indexing element in such a way as to enable selective positioning resistant to flowing air.

13. A passive air control device indexing hinge, comprising:

(a) a two arm hinge half, including two hinge arms, a projecting indexing element disposed therebetween, and a first mounting element adapted to mount and connect the two arm hinge half to a first structure; and (b) an axle hinge half, including two axles, each extending from a toothed indexing element, and a second mounting element adapted to mount and connect the axle hinge half to a second structure;

(c) wherein at least one of the first and second structures is a panel adapted to redirect air toward the other of the first and second structures when the air is directed toward the panel;

(d) wherein when the axle hinge half is connected to the two arm hinge half by interconnecting each axle with a respective hinge arm, the projecting indexing element abuts the toothed indexing element in such a way as to prevent rotation and enable selective positioning resistant to the flowing air unless an additional rotational torque is applied by user;

(e) wherein the two arm hinge half, the axle hinge half, and the first and second structures are all entirely disposed within an interior of an electronic equipment enclosure; and (f) wherein the at least one of the first and second structures that is a panel adapted to redirect air toward the other of the first and second structures is adapted to redirect air flowing through the interior of the electronic equipment enclosure.

14. The indexing hinge of claim 13, wherein each axle has two flat surfaces arranged therein to permit interconnection of the axle to a respective hinge arm.

15. The indexing hinge of claim 13, wherein the toothed indexing element is formed in the shape of a nearly complete cylinder and extends from a proximal end of the second mounting element such that the axis of the cylinder generally parallels the proximal end of the mounting element.

16. The indexing hinge of claim 15, wherein the cylinder defines curved surfaces and two bases, wherein the toothed indexing element includes a plurality of teeth covering the curved surfaces of the cylinder, and wherein the teeth extend generally from one cylinder base to the other and define a plurality of detents therebetween.

17. The indexing hinge of claim 13, wherein the projecting indexing element includes a short protrusion with a rounded or beveled tip that abuts the toothed indexing element in such a way as to prevent rotation unless an additional rotational torque is applied.

18. The indexing hinge of claim 13, wherein each hinge barrel section defines a partially-enclosed opening of substantially cylindrical cross-section, and the two hinge barrel sections are aligned such that the cylindrical openings are collinear.

19. The indexing hinge of claim 18, wherein a distance from a tip of the projecting indexing element to a center of the cylindrical openings is greater than a radius of the cylindrical openings and wherein the tip of the projecting indexing element is arranged to interact with the toothed indexing element in such a way as to prevent rotation unless an additional rotation torque is applied.

20. The indexing hinge of claim 13, wherein the first mounting element and the second mounting element each include a first mounting section and a second mounting section separated by a slot, wherein a U-shaped structure is disposed.

21. The indexing hinge of claim 20, wherein the U-shaped structure includes a ramped structure and a tapered structure disposed in opposing facing relation to one another to aid in mounting the corresponding hinge half to a door, wall or other planar structure.

22. The indexing hinge of claim 13, wherein the hinge arms act as a spring by extending and contracting slightly as the projecting indexing element and toothed indexing element interact with one another when the additional rotational torque is applied to the indexing hinge to cause rotation thereof.

23. An electronic equipment enclosure installation, comprising (a) an electronic equipment enclosure, including a first structure and a second structure, at least one of which is a door structure against which air is directed, and (b) an indexing hinge rotatably supporting the door structure, comprising:

(i) a two arm hinge half, including two hinge arms, a projecting indexing element disposed therebetween, and a first mounting element adapted to mount and connect the two arm hinge half to the first structure of the electronic equipment enclosure; and (ii) an axle hinge half, including two axles, each extending from a toothed indexing element, and a second mounting element adapted to mount and connect the axle hinge half to the second structure of the electronic equipment enclosure;

(iii) wherein when the axle hinge half is connected to the two arm hinge half by interconnecting each axle with a respective hinge arm, the projecting indexing element abuts the toothed indexing element in such a way as to prevent rotation of the door structure, when air is directed against the door structure, unless an additional rotational torque is applied;

(c) wherein the door structure may be selectively positioned to control the flow of air in the electronic equipment enclosure;

(d) wherein the door structure and the indexing hinge are both entirely disposed within an interior of the electronic equipment enclosure;

(e) wherein the indexing hinge is configured such that, when the two arm hinge half is mounted to the first structure of the electronic equipment enclosure and the axle hinge half is mounted to the second structure of the electronic equipment enclosure, the first structure is rotatable relative to the second structure.

* * * * *